US005249670A

United States Patent [19]

Simon

[11] Patent Number: 5,249,670

[45] Date of Patent: Oct. 5, 1993

[54] AWARD RECOGNITION PACKAGE

[75] Inventor: Doris M. Simon, Owatonna, Minn.

[73] Assignee: Jostens, Inc., Minneapolis, Minn.

[21] Appl. No.: 850,097

[22] Filed: Mar. 11, 1992

[51] Int. Cl.[5] ..... B65D 25/00

[52] U.S. Cl. ..... 206/45.31; 206/474; 206/475; 206/486; 206/491

[58] Field of Search ..... 206/45.31, 472, 474, 206/475, 566, 486, 487, 491; 229/87.06, 162

[56] References Cited

U.S. PATENT DOCUMENTS

| | | | |
|---|---|---|---|
| 968,286 | 8/1910 | Streit | 206/45.31 |
| 1,228,714 | 6/1917 | Stortz | 206/45.31 |
| 1,310,729 | 7/1919 | Appelbee | 206/475 |
| 2,007,089 | 7/1935 | Jones | 206/45.31 |
| 2,077,570 | 4/1937 | Lamare | 206/491 X |
| 2,285,991 | 6/1942 | Lester | 206/45.31 |
| 2,314,721 | 3/1943 | Lowenstein | 206/45.31 X |
| 2,859,866 | 11/1958 | Altenbern et al. | 206/45.31 |
| 2,874,828 | 2/1959 | Neugebauer | 206/45.31 X |
| 2,959,340 | 11/1960 | Hennessey | 206/588 X |
| 3,486,615 | 12/1969 | De Woskin | 206/491 |
| 5,071,025 | 12/1991 | Boots | 220/410 |

*Primary Examiner*—Bryon P. Gehman
*Attorney, Agent, or Firm*—Vidas, Arrett & Steinkraus

[57] ABSTRACT

The award recognition package is formed from an originally flat diecut blank of paper stock. The blank is diecut so as to form a rectangular base section with four sides, with four flaps extending from each of the four sides of the base section. Each flap has a pair of bend scores so that as each flap is folded up and over onto the base section the award recognition package is formed into a thin box which displays the award recognition pin, tack, medallion or the like.

4 Claims, 10 Drawing Sheets

AWARD RECOGNITION PACKAGE

BACKGROUND OF THE INVENTION

1. Field of the Invention

This invention relates to a package, and more particularly to an award recognition package.

SUMMARY OF THE INVENTION

The inventive award recognition package is very inexpensive to manufacture, easy to store and erect, and when erected forms a very attractive award recognition package.

The award recognition package is formed from an originally flat diecut blank of paper stock. The blank is diecut so as to form a rectangular base section with four sides, with four flaps extending from each of the four sides of the base section. Each flap has a pair of bend scores so that as each flap is folded up and over onto the base section the award recognition package is formed into a thin box which displays the award recognition pin, tack, medallion or the like.

DESCRIPTION OF THE PREFERRED EMBODIMENTS

Figure 1:
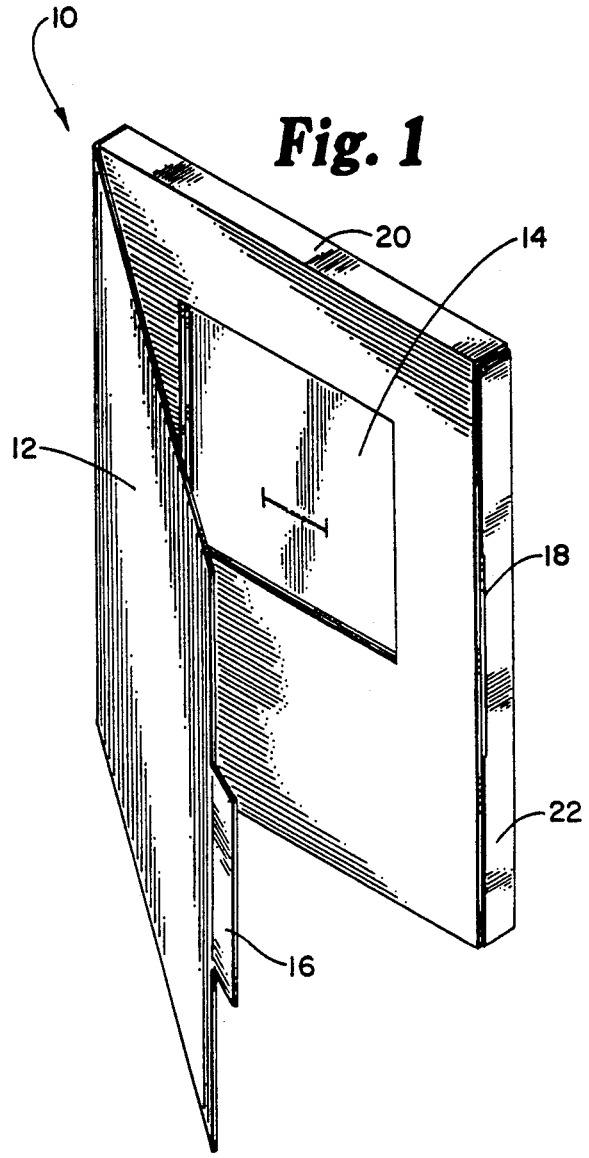
FIG. 1 is a perspective view of the inventive award recognition package, shown partially open.

While this invention may be embodied in many different forms, there are shown in the drawings and described in detail herein specific preferred embodiments of the invention. The present disclosure is an exemplification of the principles of the invention and is not intended to limit the invention to the particular embodiments illustrated.

Referring now to FIG. 1, shown generally at 10, the inventive award recognition package is shown in its final form with the package opened. Package 10 takes the form of a fairly thin box with four sides and a top and bottom. The top and bottom of the package can also be referred to as the front and back. The front or top of the package can also be referred to as the cover.

Figure 2:
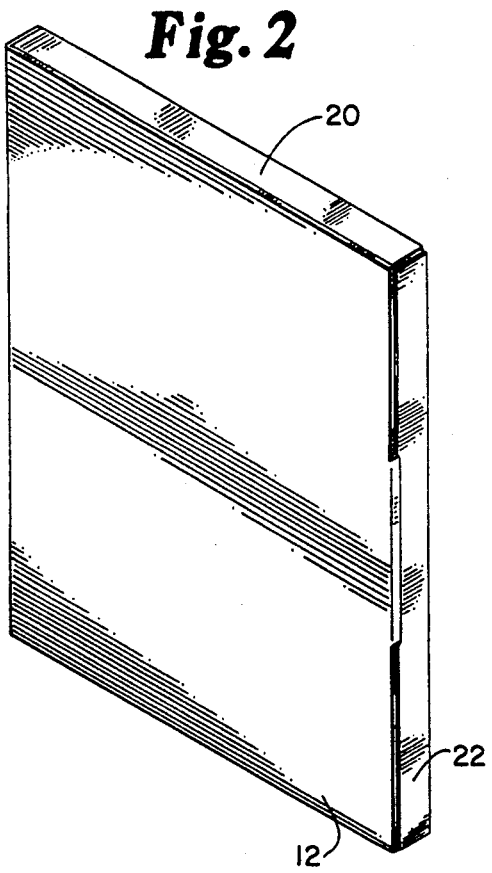
FIG. 2 is a perspective of FIG. 1 shown closed.

FIGS. 1 and 2 show the package 10 with the cover 12 shown in the open position. Reference numeral 14 shows a display area to which the particular award is attached for display. The award (not shown) could be a pin, medallion, tack or the like. Cover 12 has tab 16 which is designed to mate with tab slot 18 to close the package (shown in FIG. 2). Reference numeral 20 denotes the top side of the package while reference numeral 22 denotes the right side of the package.

Figures 3, 4:
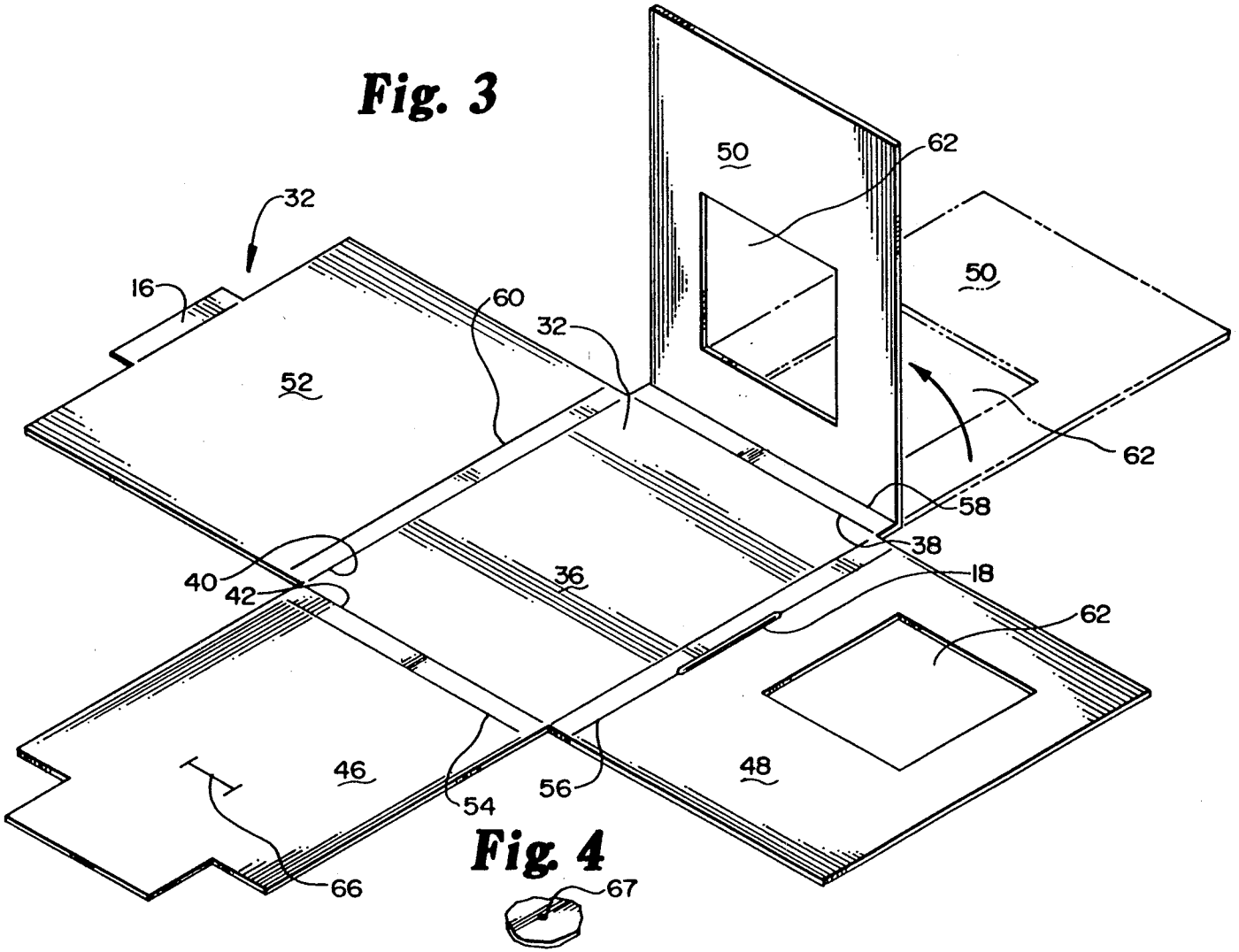
FIG. 3 is a perspective view thereof showing a first stage of erecting the package.
FIG. 4 is an alternative embodiment of the attachment means for attaching the award to the award display area shown in FIG. 3.

FIG. 3 shows the award recognition package before it is erected. The award recognition package is made of an originally flat diecut blank of relatively stiff foldable sheet stock, as is well known in the art and is generally referred to at 30. The blank 30 has front and back surfaces, the front surface being shown at 32 and the back surface being shown at 34 in FIG. 5. The blank 30 has been precut as shown in FIG. 3 and is comprised of a base section 36 which has top, left, bottom and right sides shown respectively at 38, 40, 42 and 44. Reference numerals 38, 40, 42 and 44 indicate bend scores as will be discussed further below. Bottom flap 46 extends from base section 36 at 42. Right flap 48 extends from base section 36 at bend score 44. Top flap 50 extends from base section 36 at bend score 38. Left flap 52 extends from base section 36 at bend score 40. All four flaps, 46, 48, 50 and 52, have a second bend score shown respectively at reference numerals 54, 56, 58 and 60. The second set of bend score lines are positioned a predetermined distance from the first bend scores, and the sheet stock between the two sets of bend scores forms the four sides of the award recognition package as will be further discussed below. Right flap 48 and top flat 50 are provided with a window cut out indicated at reference numeral 62. A tab slot or slit 18 is provided along a portion of bend score 56 and is arranged to mate with tab 16. Slit 66 is provided in bottom flap 46 to hold an award pin, award medallion or the like (not shown).

FIG. 4 is an alternative embodiment showing that the award attachment means 66 of FIG. 3 can also be in the form of a tackette hole 67 to which a tack pin could be attached. In this embodiment, a thin piece of foam (not shown) could also be inserted into the package to prevent the tack pin from spinning.

Figure 5:
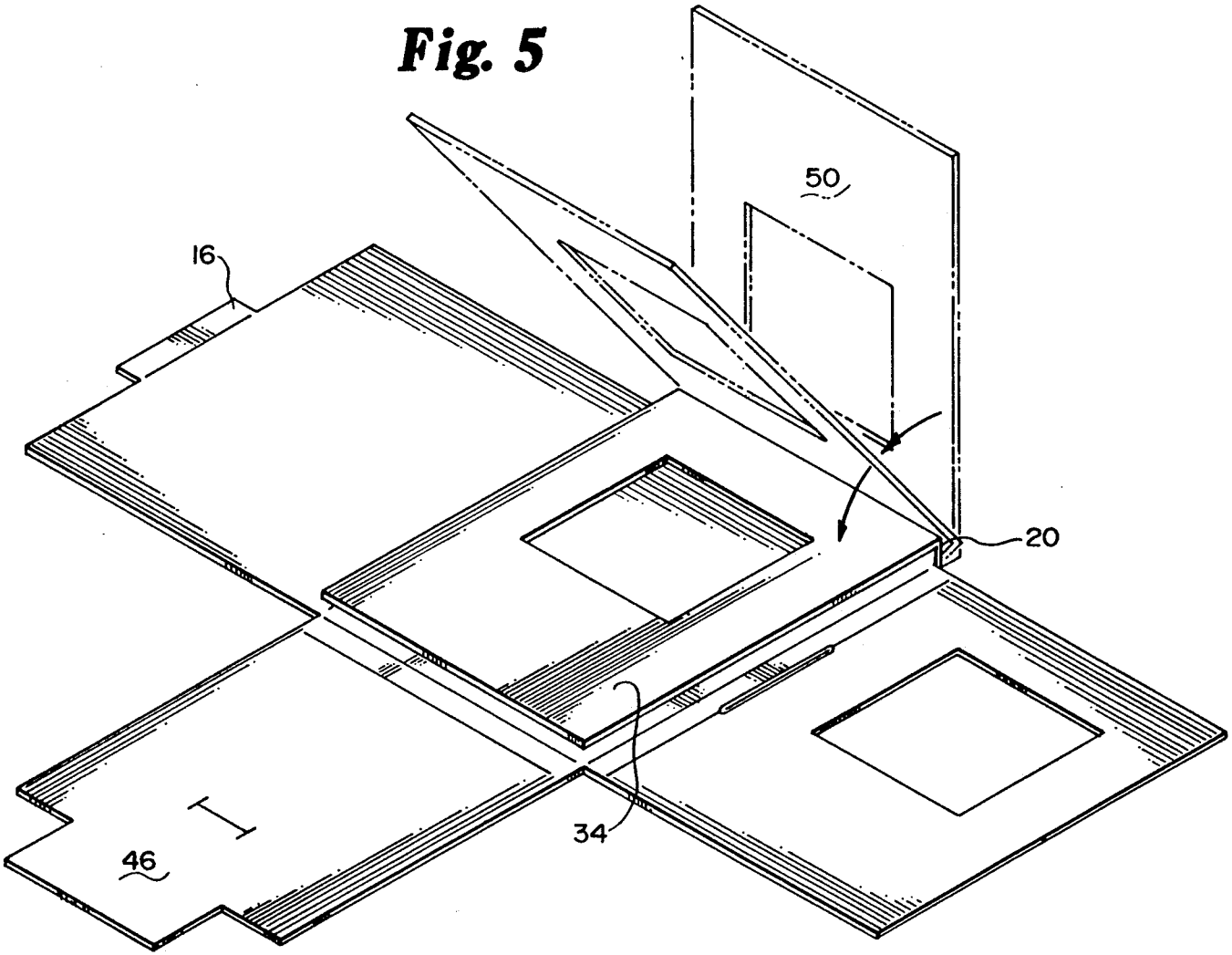
FIG. 5 is a perspective view thereof showing a second stage of erecting the package.

FIGS. 3 and 5 show that as a first step in erecting the award recognition box 10, top flap 50 is bent up and over in a two fold manner until the front surface 32 of flap 50 is lying flat on the front surface of base section 36. It can also be seen in FIG. 5 that folded flap 50 forms the top side 20 of package 10 (seen best in FIG. 1).

Figure 6:
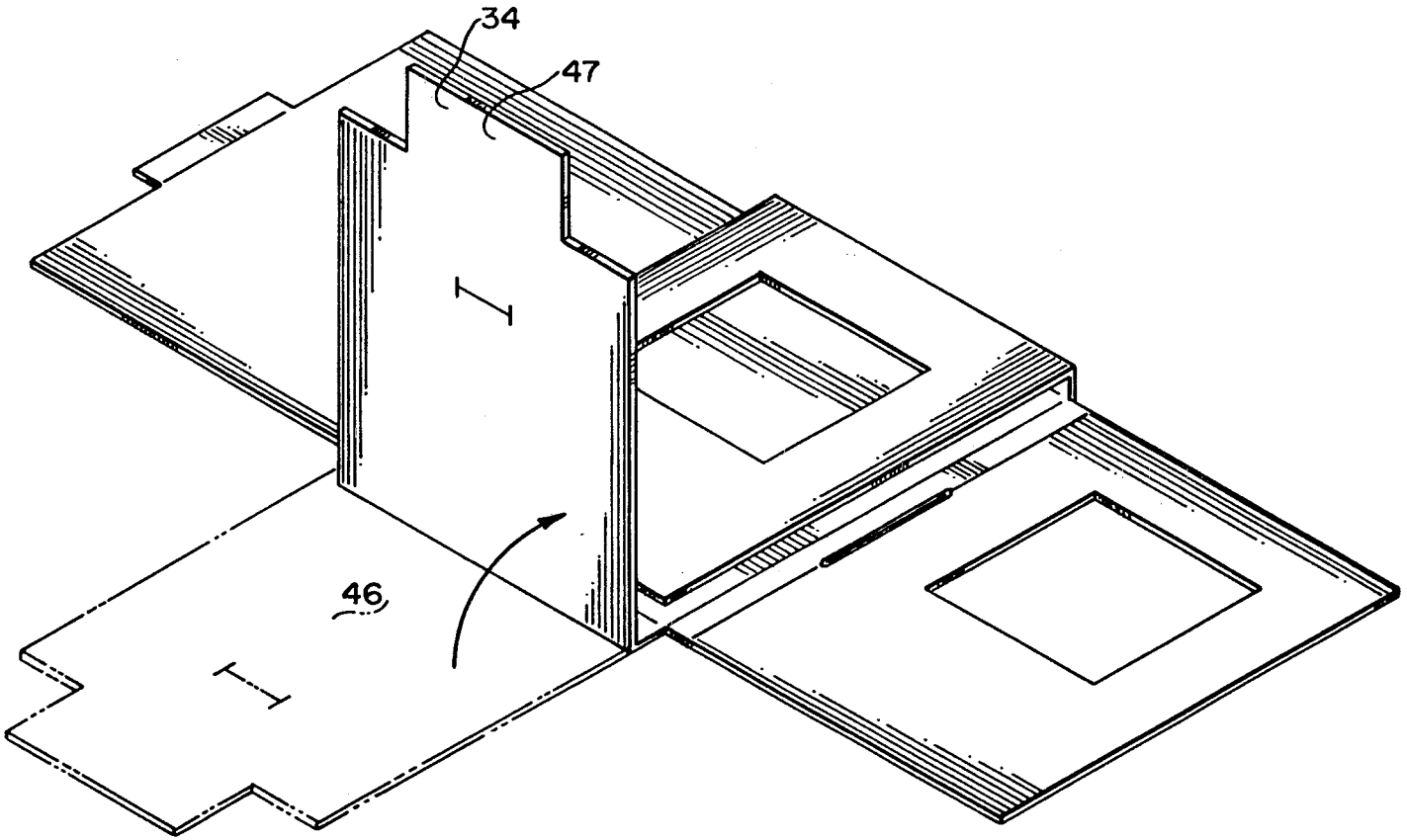
FIG. 6 is a perspective view thereof showing a third stage of erecting the package.
Figure 7:
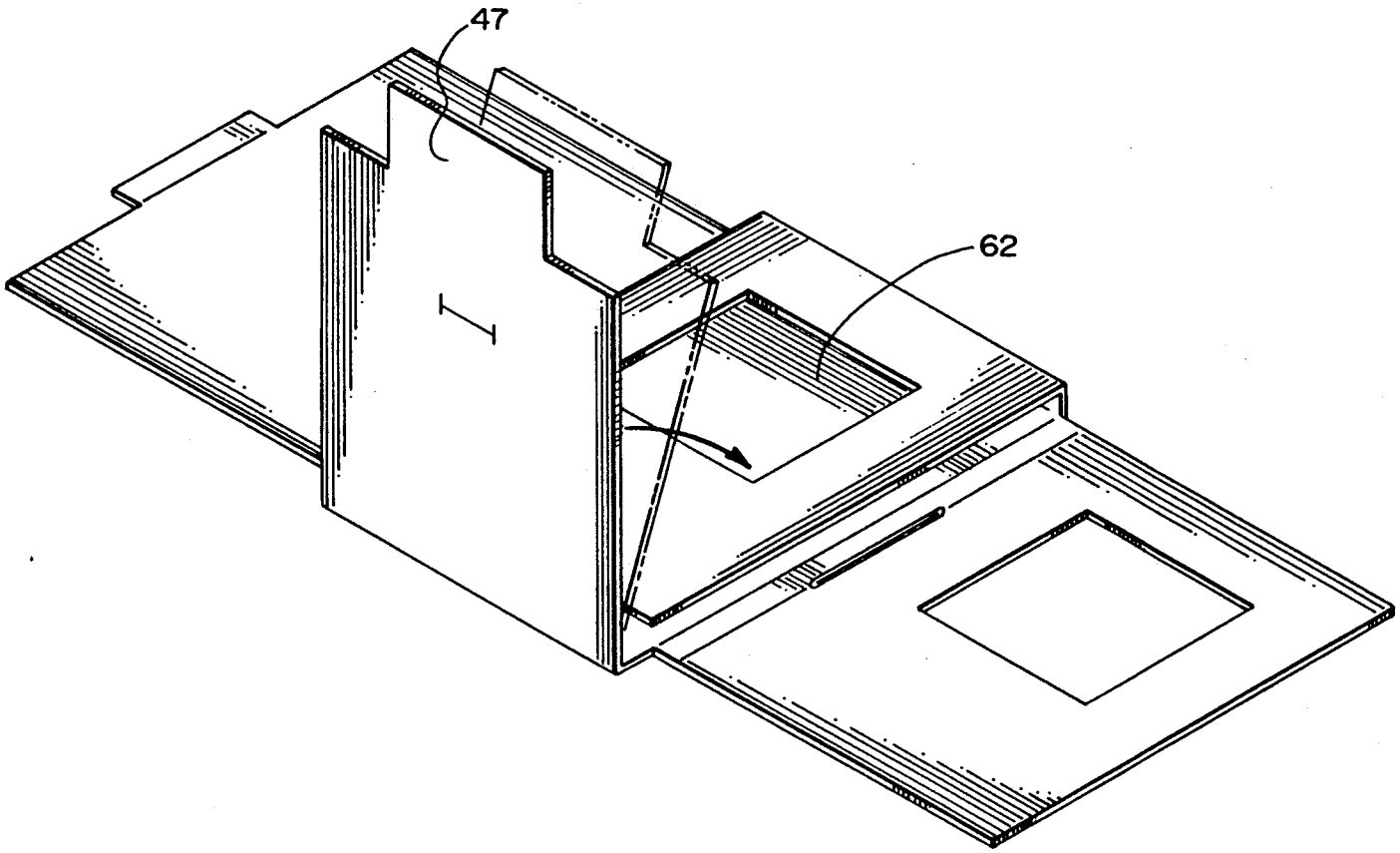
FIG. 7 is a perspective view thereof showing a fourth stage of erecting the package.
Figure 8:
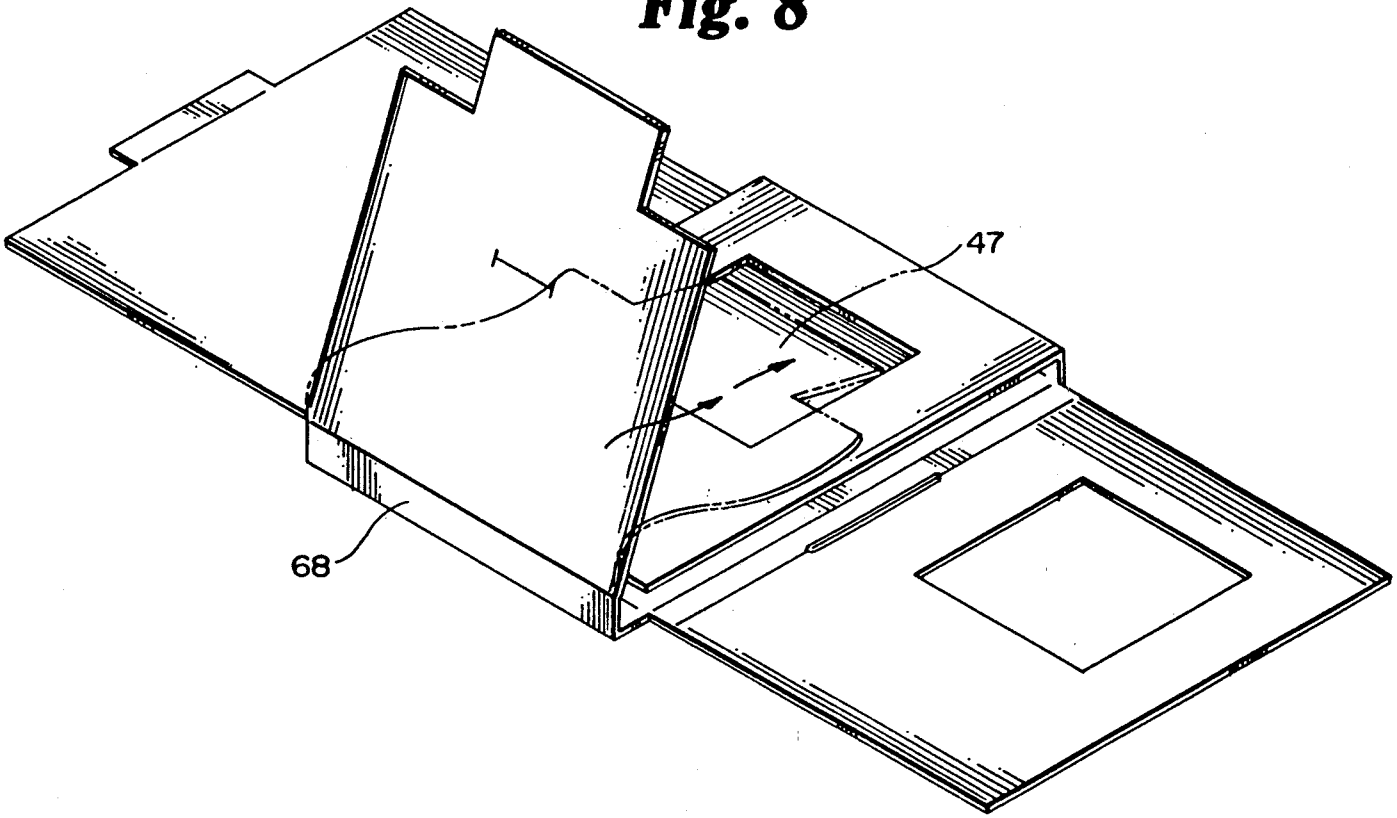
FIG. 8 is a perspective view thereof showing a fifth stage of erecting the package.

Referring now to FIGS. 6–8, it can be seen that bottom flap 46 is bent up and over, in a two fold manner, so that tab 47 tucks into window 62 on top flap 50, and so that the front surface 32 of flap 46 lies on top of the back surface 34 of flap 50 and tab 47 fits into window 62. Folded flap 46 forms the bottom side 68 of package 10 (seen best in FIG. 8).

Figure 9:
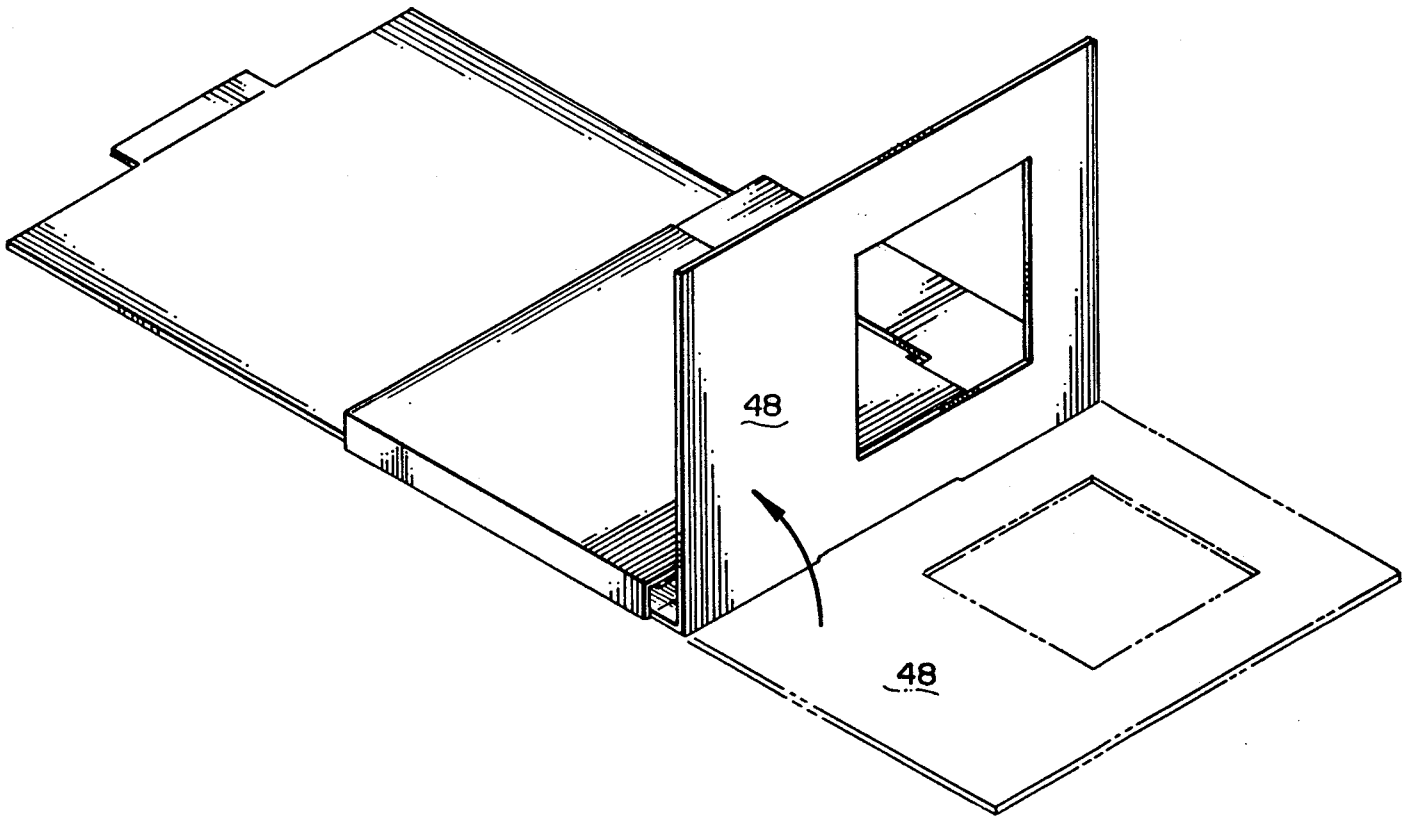
FIG. 9 is a perspective view thereof showing a sixth stage of erecting the package.
Figure 10:
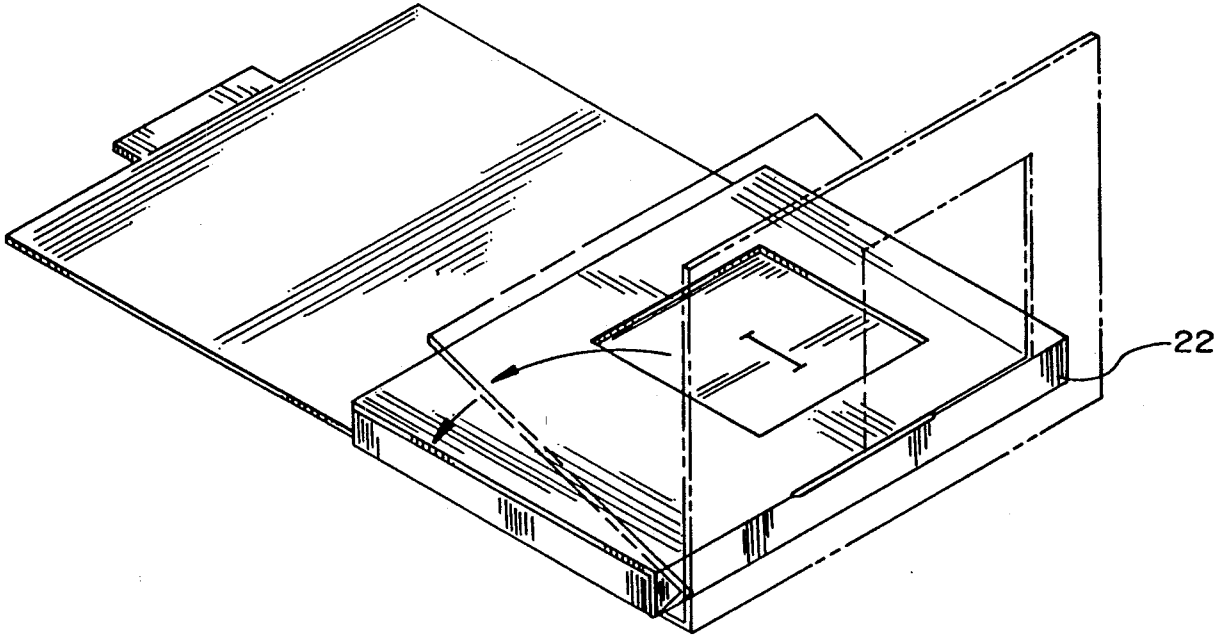
FIG. 10 is a perspective view thereof showing a seventh stage of erecting the package.

Referring now to FIGS. 9 and 10, it can be seen that right flap 48 is bent up and over, in a two fold manner, so that the front surface 32 of flap 48 lies on top of the back surface 34 of flap 46. These figures also show that cut out windows 62 and flap 48 are positioned so that it displays the award attached to flap 46 at slit 66.

Figure 11:
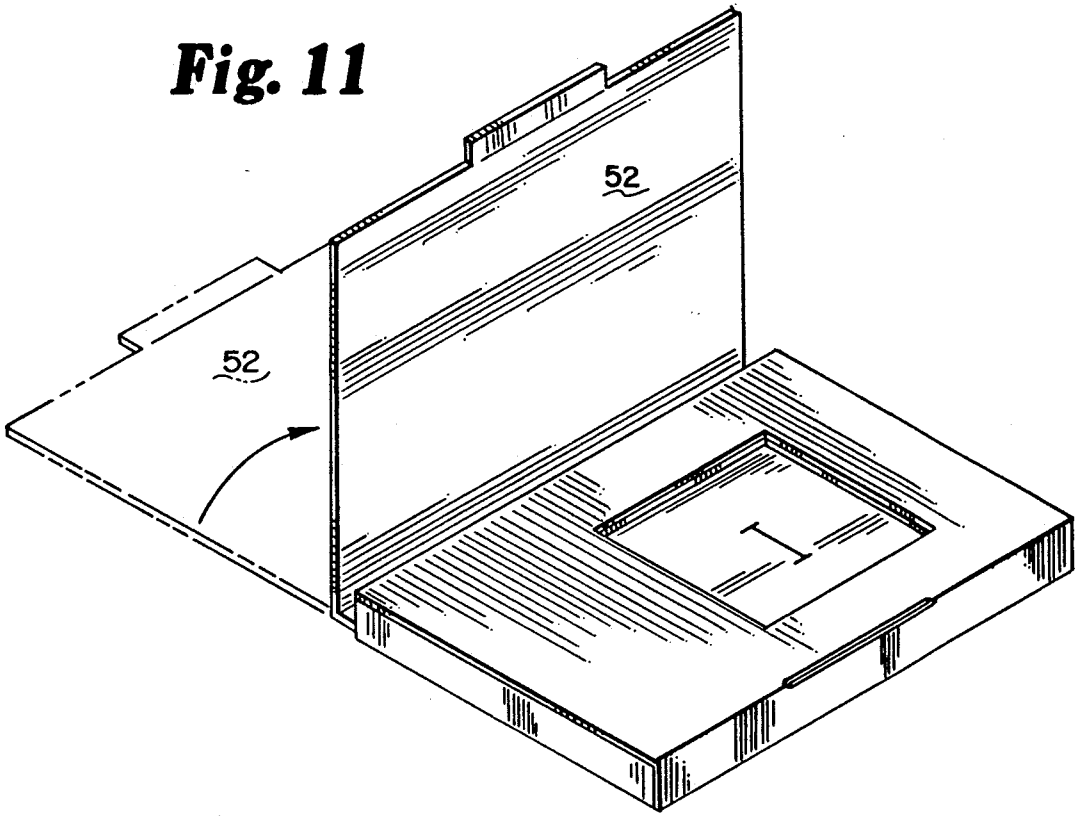
FIG. 11 is a perspective view thereof showing an eighth stage of erecting the package.
Figure 12:
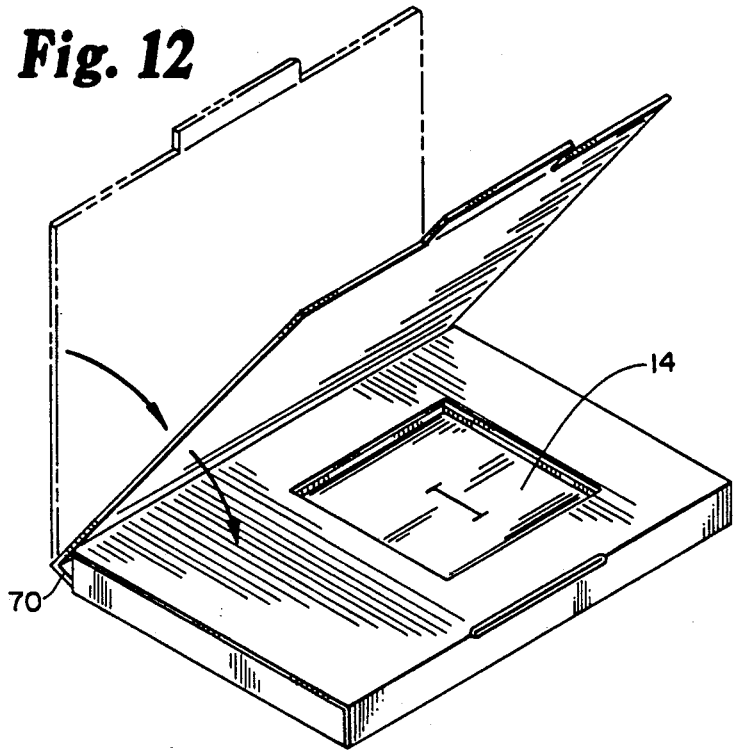
FIG. 12 is a perspective view thereof showing a ninth stage of erecting the package.

Referring now to FIGS. 11–12, left flap 52 folds up and over in a two fold manner so that the top surface 32 of flap 52 lies in the back surface 34 of flap 48. Folded flap 52 also forms the left side 70 of package 10 (shown best in FIG. 12).

Figure 13:
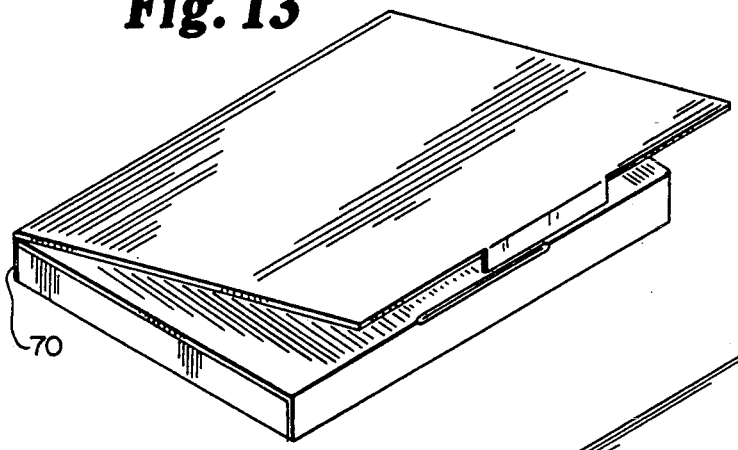
FIG. 13 is a perspective view thereof showing a tenth stage of erecting the package.
Figure 14:
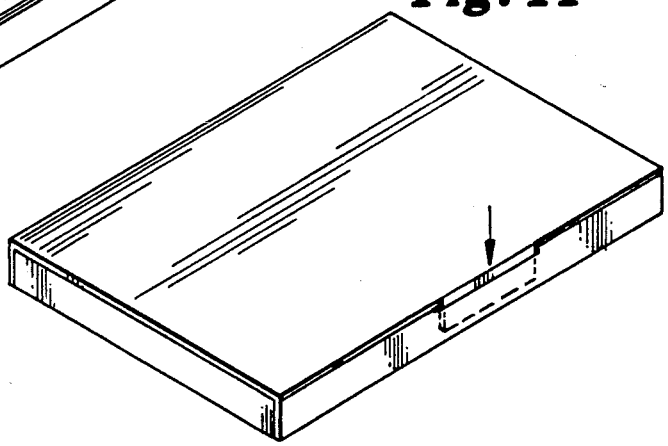
FIG. 14 is a perspective view thereof showing the package closed.

FIGS. 13 and 14 show how tab 16 is received by slot 18 to close the award recognition package 10.

In use the award pin or medallion is attached to the front surface 32 of flap 46 and the package is closed. When the person to whom the award is being given opens package 10, the award is clearly visible through windows 62 on flaps 48 and 50, and is presented in an attractive manner.

It should also be understood that the flaps could be closed in a different order and still form package 10. For example, instead of folding the flaps in the preferred manner as follows: 50, 46, 48, 52 the package 10 could be formed by folding the flaps as follows: 46, 48, 50, and 52. Package 10 could also be formed by folding the flaps as follows: 46, 50, 48, and 52. It should also be understood that the tab 16 and tab slots 18 could be reversed on their respective flaps.

As should be clear from the above disclosure, the award box 10 can be sized as desired and formed in many different shapes. Package 10 could also be thicker or thinner simply by varying the amount of stock between the two sets of scores on each of the flaps 46–52. The front or back surface of the sheet stock 30 could also be imprinted with text information, art work, corporate identification etc.

This completes the description of the preferred and alternate embodiments of the invention. Those skilled in the art may recognize other equivalents to the specific embodiment described herein which equivalents are intended to be encompassed by the claims attached hereto.

What is claimed is:

1. An award recognition package having a top side and a bottom side and four sides, comprising:

an originally flat blank of relatively stiff foldable sheet stock having a back surface and a front surface, the sheet stock cut so as to define a generally rectangular base section having first, second, third and fourth sides, and first, second, third and fourth flaps each extending respectively from a side of the base section;

the back surface of the base section defining the bottom side of the package;

the first flap folded up and over the front surface of the base section to define a first fold and a second fold, the first fold being positioned at the intersection of the base section and the first flap, the second fold being positioned a predetermined distance away on the first flap, the portion of sheet stock between the first and second folds forming a first side of the package;

the remaining portion of the first flap which does not fall between the first and second folds having a window cut-out;

the second flap folded up and over the back surface of the first flap to define a third fold and a fourth fold, the third fold being positioned at the intersection of the base section and second flap, the fourth fold being positioned a predetermined distance away on the second flap, the portion of sheet stock between the third and fourth folds forming a second side of the package, the second flap including a tab section which is slidably received by the window cut-out of the first flap;

the remaining portion of the second flap which does not fall between the third and fourth folds having an award display area;

the third flap folded up and over the back surface of the second flap to define a fifth fold and a sixth fold, the fifth fold being positioned at the intersection of the base section and the third flap, the sixth fold being positioned a predetermined distance away on the third flap, the portion of sheet stock between the fifth and sixth folds forming a third side of the package;

the remaining portion of the third flap which does not fall between the fifth and sixth folds having a window cut-out sized and positioned to display the award display area on the second flap;

the fourth flap folded up and over the back surface of the third flap to define a seventh fold and an eight fold, the seventh fold being positioned at the intersection of the base section and the fourth flap, the eighth fold being positioned a predetermined distance away on the fourth flap, the portion of sheet stock between the seventh and eighth folds forming a fourth side of the package, and the remaining back surface portion of the fourth flap which does not fall between the seventh and eighth folds forming a top side of the package.

2. The award recognition package of claim 1 including a tab-receiving slit made along a portion of the first fold of the third flap, and wherein the fourth flap includes a tab constructed and arranged to mate with the tab-receiving slit, thereby holding the package closed.

3. An award recognition package having back, bottom, right, top, left and front sides, comprising;

an originally flat blank of relatively stiff foldable sheet stock having a back surface and a front surface, the sheet stock cut so as to define a generally rectangular base section having top, bottom, left and right sides, and top, bottom, left and right flaps each extending respectively from a side of the base section;

the back surface of the base section defining a back side of the package;

the top flap folded up and over the front surface of the base section to define a first fold and a second fold, the first fold being positioned at the intersection of the base section and the top flap, the second fold being positioned a predetermined distance away on the top flap, the portion of sheet stock between the first and second folds forming a top side of the package;

the remaining portion of the top flap which does not fall between the first and second folds having a window cut-out;

the bottom flap folded up and over the back surface of the top flap to define a third fold and a fourth fold, the third fold being positioned at the intersection of the base section and the bottom flap, the fourth fold being positioned a predetermined distance away on the bottom flap, the portion of sheet stock between the third and fourth folds forming a bottom side of the package, the bottom flap including a tab section which is slidably received by the window cut-out of the top flap;

the remaining portion of the bottom flap which does not fall between the third and fourth folds having an award display area;

the right side flap folded up and over the back surface of the bottom flap to define a fifth fold and a sixth fold, the fifth fold being positioned at the intersection of the base section and the right side flap, the sixth fold being positioned a predetermined distance away on the right side flap, the portion of sheet stock between the fifth and sixth folds forming a right side of the package;

the remaining portion of the right side flap which does not fall between the fifth and sixth folds having a window cut-out sized and positioned to display the award display area of the bottom flap;

the left side flap folded up and over the back surface of the right flap to define a seventh fold and an eighth fold, the seventh fold being positioned at the intersection of the base section and the left side flap, the eighth fold being positioned a predetermined distance away on the left side flap, the portion of sheet stock between the seventh and eighth folds forming a left side of the package, and the remaining back surface portion of the left side flap which does not fall between the seventh and eighth folds forming a front side of the package.

4. The award recognition package of claim 3 including a tab-receiving slit made along a portion of the first fold of the right side flap, and wherein the left side flap includes a tab constructed and arranged to mate with the tab-receiving slit, thereby holding the package closed.

* * * * *